US010301149B2

(12) United States Patent
Franklin-Hensler et al.

(10) Patent No.: US 10,301,149 B2
(45) Date of Patent: May 28, 2019

(54) SYSTEM AND METHOD FOR HANDLING REEL OF PIPE

(71) Applicant: Trinity Bay Equipment Holdings, LLC, Houston, TX (US)

(72) Inventors: Tim Franklin-Hensler, Houston, TX (US); Jonathan Guerrero, Houston, TX (US); Richard Limas, Houston, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 16/176,086

(22) Filed: Oct. 31, 2018

(65) Prior Publication Data

US 2019/0127176 A1 May 2, 2019

Related U.S. Application Data

(60) Provisional application No. 62/579,980, filed on Nov. 1, 2017.

(51) Int. Cl.
*B65H 75/44* (2006.01)

(52) U.S. Cl.
CPC ..... *B65H 75/4481* (2013.01); *B65H 75/4402* (2013.01); *B65H 75/4442* (2013.01); *B65H 75/4478* (2013.01); *B65H 2701/33* (2013.01)

(58) Field of Classification Search
CPC ..... B65H 75/4481; B65H 75/4402; B65H 75/4442; B65H 75/4478; B65H 2701/33; B65H 49/24; B65H 49/34; B65H 54/42
See application file for complete search history.

(56) References Cited

U.S. PATENT DOCUMENTS 425,011 A * 4/1890 Talbert ..... B65H 16/08 242/595.1
2,207,663 A * 7/1940 Glasner ..... B21C 47/003 242/420.1
2,512,324 A * 6/1950 Hall ..... B08B 9/043 242/387
2,660,381 A * 11/1953 Friedl ..... B62B 3/104 211/1
2,679,987 A * 6/1954 Saliba ..... B65H 54/42 242/393
2,834,558 A * 5/1958 Halpin ..... B65H 16/028 242/527.5
2,904,273 A * 9/1959 Turner, Jr. ..... B21C 47/04 242/470
2,958,478 A * 11/1960 Petersen ..... B60P 3/035 242/393

(Continued)

*Primary Examiner* — Michael E Gallion
(74) *Attorney, Agent, or Firm* — Greenberg Traurig, LLP; Dwayne L. Mason; Mark G. Chretien

(57) ABSTRACT

A system includes a frame and a first pair of rollers coupled to a first side of the frame. The first pair of rollers is configured to support a first end of a pipe reel. The system also includes a first cradle disposed longitudinally between the first pair of rollers and a second pair of rollers coupled to a second side of the frame. The second pair of rollers is configured to support a second end of a pipe reel. The system also includes a second cradle disposed longitudinally between the second pair of rollers, a pipe guide coupled to a third side of the frame between the first and second sides, a pipe brake coupled to the frame, and a pipe re-spooler coupled to the frame.

18 Claims, 10 Drawing Sheets

(56) References Cited

U.S. PATENT DOCUMENTS 3,103,322 A * 9/1963 Garner ..... B21C 47/28 242/470
3,743,205 A * 7/1973 Misrach ..... B21C 47/18 242/559.4
3,995,355 A * 12/1976 Sneed ..... B60P 3/035 29/890.144
4,085,904 A * 4/1978 McElroy ..... B65H 49/34 242/564
4,176,801 A * 12/1979 Douglas ..... B65H 49/24 242/118.4
4,454,999 A * 6/1984 Woodruff ..... B65H 49/34 242/388.7
4,804,152 A * 2/1989 Masuda ..... B65H 18/10 242/540
5,332,166 A * 7/1994 Kepes ..... B65H 54/42 242/390.2
5,956,990 A * 9/1999 Ginzburg ..... B21B 1/463 242/527.5
6,059,220 A * 5/2000 Lassiter ..... B65H 49/24 242/129
6,347,761 B1 * 2/2002 Larson ..... B65H 49/32 242/390.5
8,398,013 B2 * 3/2013 Skalleberg ..... B65H 49/24 242/393
8,814,075 B1 * 8/2014 Turner ..... B65H 75/446 242/403
8,931,724 B2 * 1/2015 Jordan ..... B65H 49/38 242/403
10,017,352 B2 * 7/2018 Braack ..... B65H 75/425
10,150,402 B2 * 12/2018 White ..... B60P 1/16
2007/0120003 A1 * 5/2007 Grant ..... B65H 49/24 242/557
2009/0196723 A1 * 8/2009 Smith ..... B60P 3/035 414/546
2010/0243787 A1 * 9/2010 Skalleberg ..... B65H 49/24 242/484.6
2015/0158692 A1 * 6/2015 Reynolds ..... B65H 75/425 242/390.2
2017/0197536 A1 * 7/2017 Mayer ..... B60P 3/035
2018/0186269 A1 * 7/2018 Barnett ..... B60P 1/16

* cited by examiner

SYSTEM AND METHOD FOR HANDLING REEL OF PIPE

CROSS-REFERENCE TO RELATED APPLICATIONS

This application claims the benefit, and priority benefit, of U.S. Provisional Application 62/579,980 filed Nov. 1, 2017, the disclosure of which is incorporated by reference herein in its entirety.

BACKGROUND

Flexible pipe is useful in a myriad of environments, including in the oil and gas industry. Flexible pipe may be durable and operational in harsh operating conditions and can accommodate high pressures and temperatures. Flexible pipe may be bundled and arranged into one or more coils to facilitate transporting and using the pipe.

Coils of pipe may be positioned in an "eye to the side" or "eye to the sky" orientation. When the flexible pipe is coiled and is disposed with its interior channel facing upwards, such that the coil is in a horizontal orientation, then the coils of pipe are referred to as being in an "eye to the sky" orientation. If, instead, the flexible pipe is coiled and disposed such that the interior channel is not facing upwards, such that the coil is in an upright or vertical orientation, then the coils of pipe are referred to as being in an "eye to the side" orientation.

The flexible pipe may be transported as coils to various sites for deployment (also referred to as uncoiling or unspooling). Different types of devices and vehicles are currently used for loading and transporting coils of pipe, but usually extra equipment and human manual labor is also involved in the process of loading or unloading such coils for transportation and/or deployment. Such coils of pipe are often quite large and heavy. Accordingly, there exists a need for an improved method and apparatus for loading and unloading coils of pipe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a system that includes a frame and a first pair of rollers coupled to a first side of the frame. The first pair of rollers is configured to support a first end of a pipe reel. The system also includes a first cradle disposed longitudinally between the first pair of rollers and a second pair of rollers coupled to a second side of the frame. The second pair of rollers is configured to support a second end of a pipe reel. The system also includes a second cradle disposed longitudinally between the second pair of rollers, a pipe guide coupled to a third side of the frame between the first and second sides, a pipe brake coupled to the frame, and a pipe re-spooler coupled to the frame.

In another aspect, embodiments of the present disclosure relate to a method that includes providing a pipe reel cradle. The pipe reel cradle includes a frame and a first pair of rollers coupled to a first side of the frame. The first pair of rollers is configured to support a first end of a pipe reel. The pipe reel cradle also includes a first cradle disposed longitudinally between the first pair of rollers and a second pair of rollers coupled to a second side of the frame. The second pair of rollers is configured to support a second end of a pipe reel. The pipe reel cradle also includes a second cradle disposed longitudinally between the second pair of rollers, a pipe guide coupled to a third side of the frame between the first and second sides, and a pipe brake coupled to the frame. The method also includes setting the pipe reel in the pipe reel cradle. A spoolable pipe is disposed about the pipe reel. The method also includes guiding the spoolable pipe through the pipe guide as spoolable pipe is removed from the pipe reel, rotating the pipe reel against the first and second pairs of rollers as spoolable pipe is removed from the pipe reel, and at least one of slowing or stopping rotation of the pipe reel by engaging the pipe brake against the pipe reel.

In another aspect, embodiments of the present disclosure relate to a method that includes providing a pipe reel cradle. The pipe reel cradle includes a frame and a first pair of rollers coupled to a first side of the frame. The first pair of rollers is configured to support a first end of a pipe reel. The pipe reel cradle also includes a first cradle disposed longitudinally between the first pair of rollers and a second pair of rollers coupled to a second side of the frame. The second pair of rollers is configured to support a second end of a pipe reel. The pipe reel cradle also includes a second cradle disposed longitudinally between the second pair of rollers, a pipe guide coupled to a third side of the frame between the first and second sides, and a pipe re-spooler coupled to the frame. The method also includes setting the pipe reel in the pipe reel cradle. A first portion of spoolable pipe is disposed about the pipe reel and a second portion of spoolable pipe extends away from the pipe reel. The method also includes engaging the pipe re-spooler against the pipe reel, rotating the pipe re-spooler to cause rotation of the pipe reel against the first and second pairs of rollers to re-spool the second portion onto the pipe reel, and guiding the second portion through the pipe guide as the section portion is re-spooled.

Other aspects and advantages of the claimed subject matter will be apparent from the following description and the appended claims.

DETAILED DESCRIPTION

Figure 1:
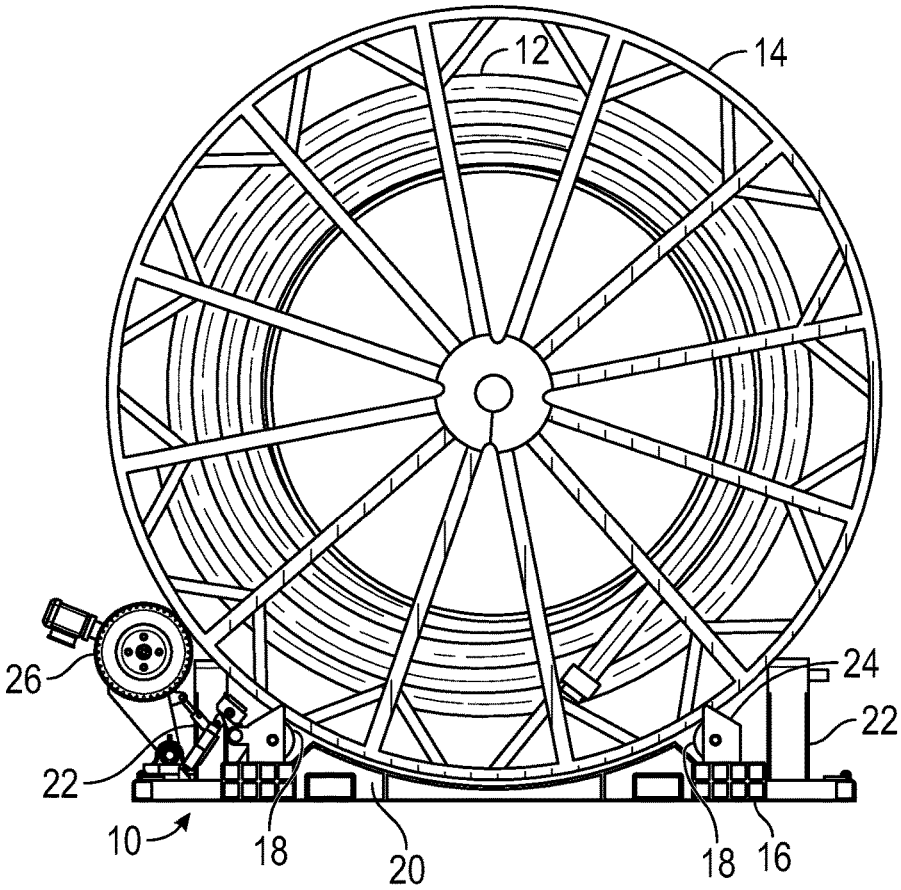
FIG. 1 is a block diagram of a pipe reel cradle according to embodiments of the present disclosure.

Embodiments of the present disclosure relate generally to systems used for deploying reels of flexible pipe. Pipe reel cradles according to embodiments of the present disclosure may include a frame, rollers, cradles, a pipe guide, a pipe brake, and a pipe re-spooler.

Embodiments of the present disclosure will be described below with reference to the figures. In one aspect, embodiments disclosed herein relate to embodiments for deploying spoolable pipe using the pipe reel cradle.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

FIG. 1 illustrates a block diagram of an embodiment of a pipe reel cradle 10. As described in detail below, the pipe reel cradle 10 may be used to deploy spoolable pipe 12, which may refer to any type of flexible pipe or piping capable of being bent into a coil. The spoolable pipe 12 may be wound on a spool or reel 14. Such reels of spoolable pipe 12 may reduce the amount of space taken up by pipe during manufacturing, shipping, transportation, and deployment compared to rigid pipe that is not capable of being bent into a coil.

Pipe, as understood by those of ordinary skill, may be a tube to convey or transfer any water, gas, oil, or any type of fluid known to those skilled in the art. The spoolable pipe 12 may be made of any type of materials including without limitation plastics, metals, a combination thereof, composites (e.g., fiber reinforced composites), or other materials known in the art. One type of spoolable pipe 12 is flexible pipe, which is used frequently in many applications, including without limitation, both onshore and offshore oil and gas applications. Flexible pipe may include Bonded or Unbonded Flexible Pipe, Flexible Composite Pipe (FCP), Thermoplastic Composite Pipe (TCP), or Reinforced Thermoplastic Pipe (RTP). A FCP/RTP pipe may itself be generally composed of several layers. In one or more embodiments, a flexible pipe may include a high-density polyethylene ("HDPE") liner having a reinforcement layer and an HDPE outer cover layer. Thus, flexible pipe may include different layers that may be made of a variety of materials and also may be treated for corrosion resistance. For example, in one or more embodiments, pipe used to make up a coil of pipe may have a corrosion protection shield layer that is disposed over another layer of steel reinforcement. In this steel-reinforced layer, helically wound steel strips may be placed over a liner made of thermoplastic pipe. Flexible pipe may be designed to handle a variety of pressures, temperatures, and conveyed fluids. Further, flexible pipe may offer unique features and benefits versus steel/carbon steel pipe lines in the area of corrosion resistance, flexibility, installation speed and re-usability. Another type of spoolable pipe is coiled tubing, which may be made of steel. Coiled tubing may also have a corrosion protection shield layer.

The pipe reel cradle 10 of FIG. 1 includes a frame 16 that provides a base for supporting components of the pipe reel cradle 10. For example, rollers 18 may be coupled to the frame 16 and be used to support the reel 14. Cradles 20 may also be coupled to the frame 16 and be disposed between the rollers 18. In addition, one or more pipe guides 22 may be coupled to the frame 16 and used to guide the spoolable pipe 12 during deployment from the reel 14. A pipe brake 24 may be coupled to the frame 16 and used to slow or stop rotation of the reel 14. Finally, a pipe re-spooler 26 may be coupled to the frame 16 and used to re-spool portions of spoolable pipe 12 back onto the reel 14. These components of the pipe reel cradle 10 are described in more detail below. In addition, although the rollers 18, pipe brake 24, and the pipe re-spooler 26 are described separately below, in certain embodiments, the rollers 18 may provide the functionality of one or both of the pipe brake 24 and the pipe re-spooler 26. In yet further embodiments, other optional equipment may be added to the pipe reel cradle 10 or coupled to the frame 16, such as a pipe re-rounder for re-rounding the spoolable pipe 12. In still further embodiments, one or more components may be omitted from the pipe reel cradle 10, such as the pipe brake 24 and/or the pipe re-spooler 26.

Figure 2:
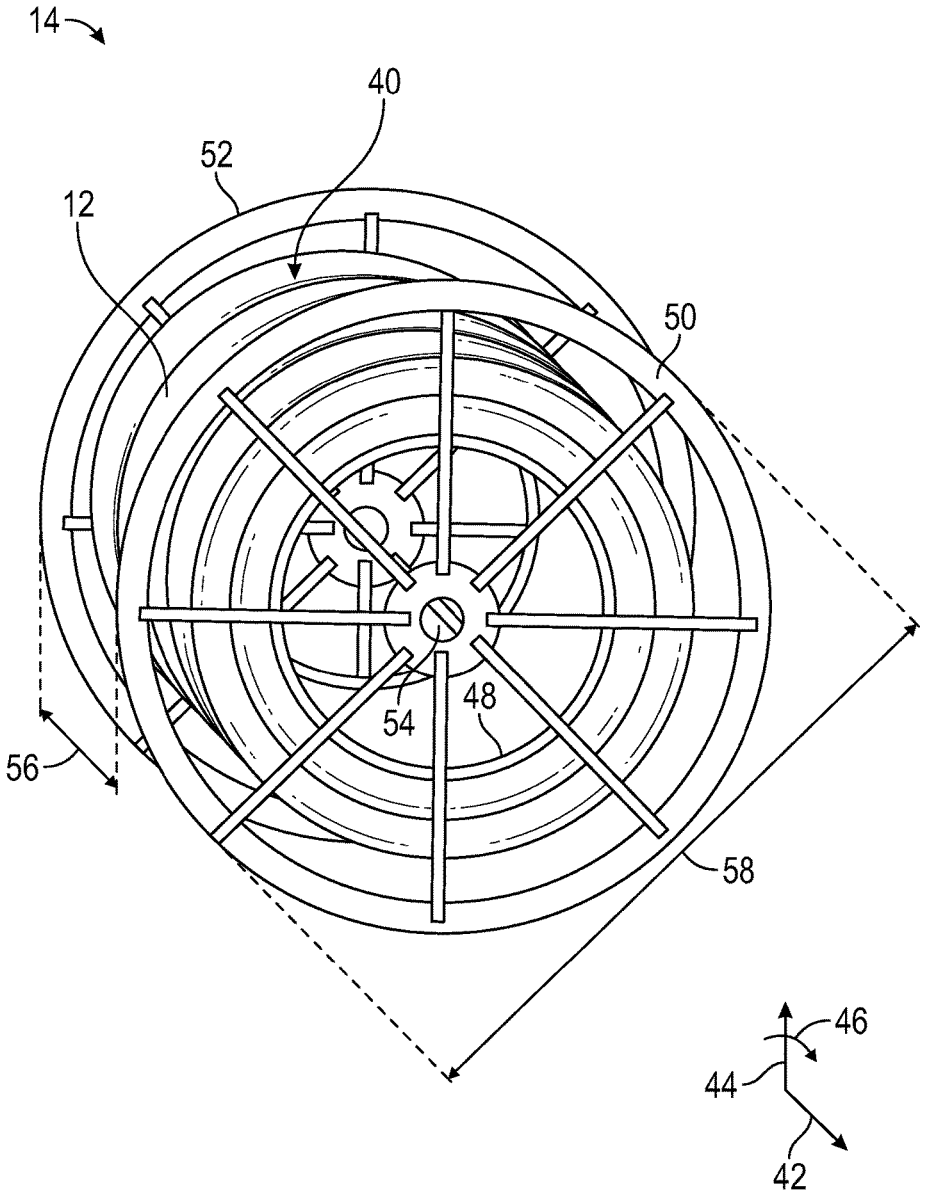
FIG. 2 is a perspective view of a reel of spoolable pipe according to embodiments of the present disclosure.

FIG. 2 illustrates a perspective view of an embodiment of the reel 14 of spoolable pipe 12. In many instances, a coil 40 of spoolable pipe 12 may be wound around the components of the reel 14. The coil 40 may be defined by an axial axis or direction 42, a radial axis or direction 44, and a circumferential axis or direction 46. The coil 40 may be wound around the reel 14 such that the interior channel of the coil 40 is concentric with a central bore of the reel 14. A reel, as understood by those of ordinary skill, may include a cylindrical drum, such as cylindrical drum 48, around which layers of pipe may be wrapped to form the coil 40. The reel 14 may include two substantially circular reel ends, namely a first reel end 50 and a second reel end 52 that are capable of turning about a shared axis. Accordingly, the first and second reel ends 50 and 52 may be attached to the cylindrical drum 48.

As shown in FIG. 2, a bore 54 is disposed in each of the first and second reel ends 50 and 52 at a substantially central position. In addition, the bores 54 for each of the first and second reel ends 50 and 52 are substantially aligned with each other (and may also be aligned with a central axis of cylindrical drum 48). Spoolable pipe 12 (e.g. flexible pipe) may be wound around the cylindrical drum 48 using any means known to those of ordinary skill in the art. In addition, the reel 14 may be defined by a reel width 56 and a reel diameter 58. In further embodiments, the reel ends 50 and 52 may be permanently or temporarily coupled to the cylindrical drum 48. In yet further embodiments, the pipe reel cradle 10 may be used with other spool-like devices similar to the reel 14, such as various embodiments of an expandable drum fitted with circular containment flanges.

Figure 3:
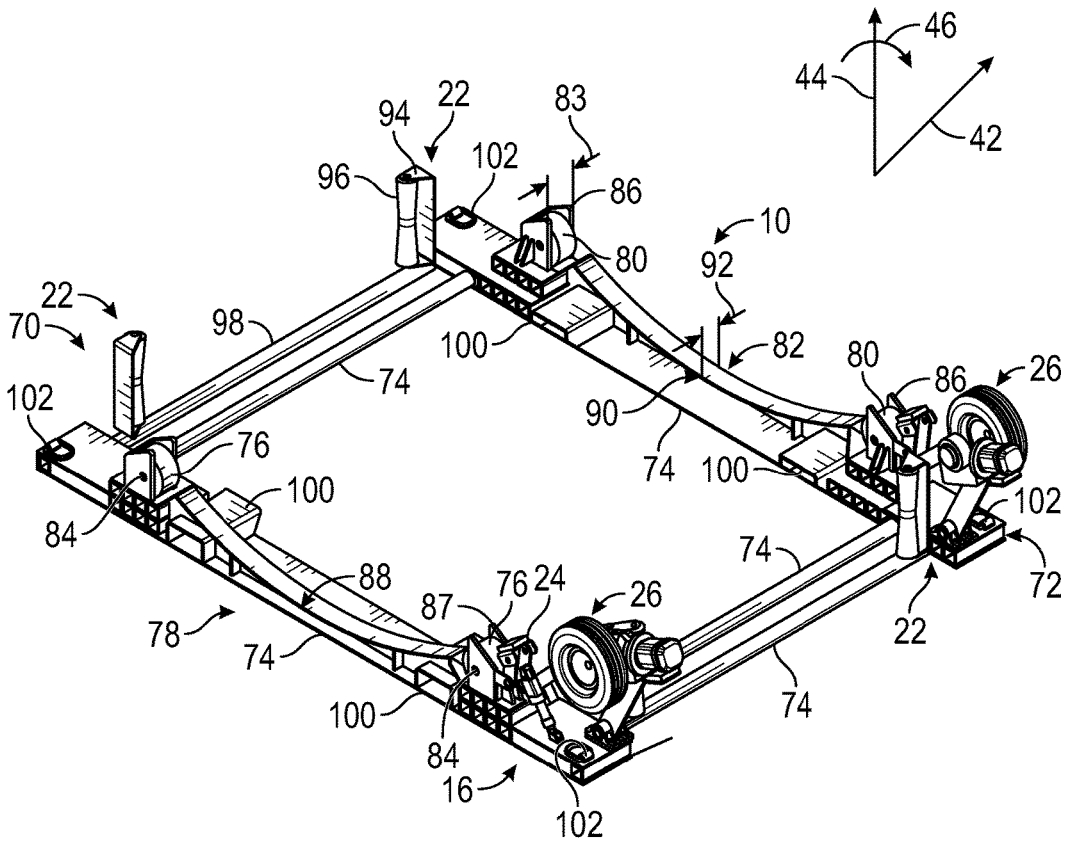
FIG. 3 is a perspective view of a pipe reel cradle according to embodiments of the present disclosure.

FIG. 3 illustrates a perspective view of an embodiment of the pipe reel cradle 10, which may have a front side 70 and a rear side 72. In the illustrated embodiment, the frame 16 is made from several structural members 74 coupled to one another such that the pipe reel cradle 10 may support the other components of the pipe reel cradle 10, the weight of the reel 14, and the weight of the spoolable pipe 12, which the combined weight of all of these may exceed 22,000 pounds (9,979 kilograms). For example, the structural members 74 may be made from square or round steel tubing, steel I-beams, or composite structural members coupled to one another via various fastening techniques, such as, but not limited to, welding or threaded connections. The frame 16 may have a generally rectangular shape, but may have other shapes, such as circles, ovals, squares or other polygons.

The illustrated embodiment of the pipe reel cradle 10 includes a first pair of rollers 76 coupled to a first side 78 of the frame 16 and a second pair of rollers 80 coupled to a second side 82 of the frame 16. The first pair of rollers 76 may support the first reel end 50 and the second pair of rollers 80 may support the second reel end 52. Thus, widths 83 of the rollers 76 and 80 may be approximately equal to or greater than the widths of the first and second reel ends 50 and 52. For example, the widths 83 of the rollers 76 and 80 may be two, three, four or more times the nominal width of the first and second reel ends 50 and 52. The additional width 83 of the rollers 76 and 80 may be useful to accommodate reels 14 with first and second reel ends 50 and 52 that are not perpendicular to one another or to accommodate reels 14 of different reel widths 56. The first and second pairs of rollers 76 and 80 may be wheels configured to rotate against the first and second reel ends 50 and 52. For example, the first and second pairs of rollers 76 and 80 may rotate about axles 84 coupled to roller frames 86 that are coupled to the frame 16.

In certain embodiments, the first and second pairs of rollers 76 and 80 may be fixedly coupled to the frame 16 and in other embodiments, positions of the first and second pairs of rollers 76 and 80 may be adjustable. For example, the first and second pairs of rollers 76 and 80 may be moved radially 44 (e.g., up and down), which could be used to move the reel 14 radially 44, or the rollers 76 and 80 may be moved axially 42 (e.g., closer or farther apart from one another), which could be used to accommodate reels 14 of different reel widths 56. In certain embodiments, the rollers of each pair of rollers 76 and 80 may be adjusted closer or farther apart from one another, which could be used to accommodate reels 14 of different reel diameters 58. Adjustment of the first and second pairs of rollers 76 and 80 may be accomplished hydraulically or electrically. In further embodiments, the first and second pairs of rollers 76 and 80 may be shaped to match the first and second reel ends 50 and 52. In other words, the shape of the first and second pairs of rollers 76 and 80 may help prevent the reel 14 from moving axially 42. For example, the first and second pairs of rollers 76 and 80 may include a flange similar to a train wheel. In some embodiments, the rollers 76 and 80 may be shaped like hourglasses, which may also help to prevent the reel 14 from moving axially 42 in either direction. Rollers 76 and 80 with hourglass shapes may also provide for smoother rotation of the reel 14 with less possibility of binding. In certain embodiments, the roller frames 86 may help prevent the reel 14 from moving axially 42. For example, the roller frames 86 may include extensions 87 that extend away from the rollers 76 and 80 to help constrain movement of the first and second reel ends 50 and 52 between the extensions 87. In further embodiments, the extensions 87 may be flared outward from a centerline of the rollers 76 and 80 to provide a funnel shape to facilitate placement of the reel 14 onto the pipe reel cradle 10. In addition, the flared extensions 87 may constrain large movement of the first and second reel ends 50 and 52 without excessively contacting the first and second reel ends 50 and 52 during small axial 42 and/or radial 44 movement of the reel 14.

The illustrated embodiment of the pipe reel cradle 10 includes a first cradle 88 disposed longitudinally between the first pair of rollers 76 and a second cradle 90 disposed longitudinally between the second pair of rollers 80. The first and second cradles 88 and 90 may support the reel 14 if the reel 14 is not supported by the first and second pairs of rollers 76 and 80, such as if the first and second pairs of rollers 76 and 80 are lowered radially 44 or damaged or worn. Thus, the first and second cradles 88 and 90 have a curved or arcuate shape that generally corresponds to the shape of the first and second reel ends 50 and 52. In certain embodiments, the first and second cradles 88 and 90 may be manufactured with different radii of curvature to accommodate reels 14 of different reel diameters 58. In addition, widths 92 of the first and second cradles 88 and 90 may be approximately equal to or greater than the widths of the first and second reel ends 50 and 52. The first and second cradles 88 and 90 may be made from curved sheet metal or other suitable material coupled to the frame 16.

In the illustrated embodiment, the pipe reel cradle 10 includes four pipe guides 22, with two disposed at the front side 70 and two disposed at the rear side 72. In other embodiments, the pipe reel cradle 10 may include two pipe guides 22 at only the front side 70 or the rear side 72. During deployment, the spoolable pipe 12 is contained between the two pipe guides 22. In certain embodiments, the pipe guides 22 includes brackets 94 and rollers 96, with pairs of rollers 96 at the front side 70 or the rear side 72 facing each other. The rollers 96 help to reduce friction if the spoolable pipe 12 contacts the pipe guides 22 during deployment. In certain embodiments, the pipe guides 22 may be coupled to a pipe guide beam 98 of the frame 16 and the pipe guides 22 may be adjustable axially 42 along the pipe guide beam 98. For example, the pipe guides 22 may be moved closer to one another for narrower reels 14 or when additional containment of the spoolable pipe 12 between the pipe guides 22 is desired. In other embodiments, the pipe guides 22 may be fixed to the frame 16 or the pipe guide beam 98. In further embodiments, the pipe guides 22 may not include rollers 96. For example, the pipe guides 22 may be coated with a low-friction material or use other techniques for reducing friction, such as bearings.

As shown in FIG. 3, the pipe reel cradle 10 may also include two or more forklift tine pockets 100 coupled to the frame 16 to enable a forklift to be used to handle and move the pipe reel cradle 10. For example, two forklift tine pockets 100 may be located at the first side 78 and two forklift tine pockets 100 may be located at the second side 82. The forklift tine pockets 100 may be sized to accommodate tines of various sizes and also may be spaced apart from one another at an appropriate distance corresponding to commonly available forklifts. Additionally or alternatively, certain embodiments of the pipe reel cradle 10 may include one or more pad eyes 102 coupled to the frame 16 to enable the pipe reel cradle 10 to be lifted using a crane or similar equipment for handling and movement. The pad eyes 102 may be located at corners of the frame 16 to provide for even weight distribution during handling. In further embodiments, the pipe reel cradle 10 may include other anchors or attachment points for other applications. For example, the pipe reel cradle 10 may be removably coupled to a trailer bed, lowboy, or ship deck during transport or deployment. In addition, certain embodiments of the pipe reel cradle 10 may include various angle brackets or supports to enable multiple pipe reel cradles 10 to be stacked on top of one another during transport. The pipe brake 24 and pipe re-spooler 26 are described in more detail below.

Figure 4:
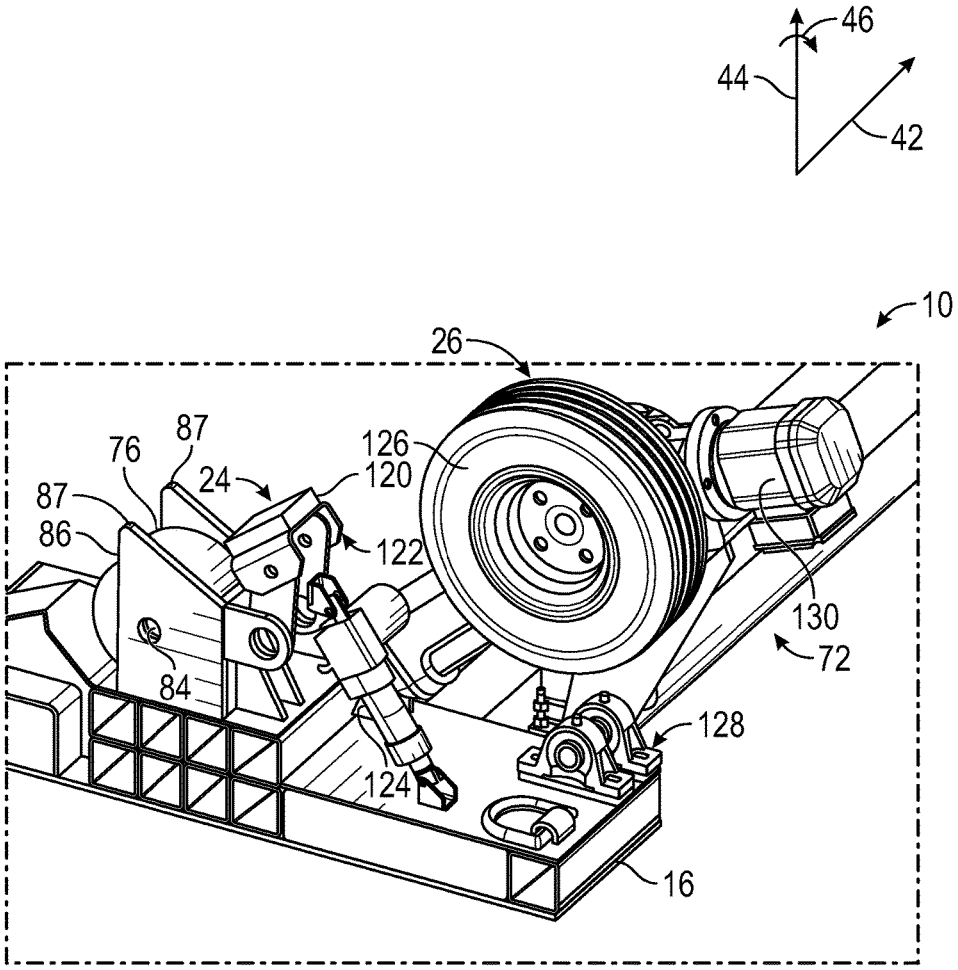
FIG. 4 is a perspective view of a pipe brake and pipe re-spooler of a pipe reel cradle according to embodiments of the present disclosure.

FIG. 4 illustrates a perspective view of the pipe brake 24 and pipe re-spooler 26 of an embodiment of the pipe reel cradle 10. Both the pipe brake 24 and pipe re-spooler 26 are coupled to the frame 16. In the illustrated embodiment, two pipe brakes 24 are shown at the rear side 72 (as shown in FIG. 3). In other embodiments, different numbers of pipe brakes 24 may be used, such as 1, 3, or 4 pipe brakes 24, and the pipe brakes 24 may be disposed at other locations, such as the front side 70 or along one or both of the first and second cradles 88 and 90. For example, the first and second cradles 88 and 90 may have cut-outs through which the pipe brake 24 protrudes. As shown in FIG. 4, the pipe brake 24 includes a brake pad 120 coupled to a brake bracket 122 that is then coupled to a brake actuator 124. When braking (e.g., slowing or stopping) of the rotating reel 14 is desired, the pipe brake 24 may be actuated to bring the brake pad 120 in contact with the rotating first and second reel ends 50 and 52. Friction between the brake pad 120 and the first and second reel ends 50 and 52 then slows or stops rotation of the reel 14. The brake pad 120 may be made from various materials, such as, but not limited to, non-metallic materials, semi-metallic materials, fully metallic materials, or ceramic materials. The brake pad 120 may be detachably coupled to the brake bracket 122 to be easily replaced when worn. The brake actuator 124 may be an electric or hydraulic actuator or motor to enable movement of the brake pad 120 toward or away from the first and second reel ends 50 and 52. The brake actuator 124 also enables adjustment of the braking force against the reel 14. The brake bracket 122 may take different forms, but serves to support the brake pad 120 and the brake actuator 124. For example, the brake bracket 122 may be coupled to the roller frame 86 and the brake actuator 124 may be coupled to the frame 16. In certain embodiments, the pipe brakes 24 may be adjustable axially 42 to accommodate reels 14 of different reel widths 56. In further embodiments, the pipe brake 24 may be configured as a caliper brake with one or more calipers to engage the first and second reel ends 50 and 52. In yet further embodiments, the rollers 18 may include the functionality of the pipe brake 24. In other words, the rollers 18 may be powered or actuated such that slowing or stopping the rotation of the rollers 18 slows or stops rotation of the reel 14. In such embodiments, the surface of the rollers 18 may be made from a material similar to the brake pad 120 to provide sufficient friction between the rollers 18 and the first and second reel ends 50 and 52.

As shown in FIG. 4, the pipe re-spooler 26 includes a wheel 126 coupled to a re-spooler bracket 128 that is then coupled to a re-spooler actuator 130. In the illustrated embodiment, two pipe re-spoolers 26 are shown at the rear side 72 (as shown in FIG. 3). In other embodiments, different numbers of pipe re-spoolers 26 may be used, such as 1, 3, or 4 pipe re-spoolers 26, and the pipe re-spoolers 26 may be disposed at other locations, such as the front side 70 or along one or both of the first and second cradles 88 and 90. For example, the first and second cradles 88 and 90 may have cut-outs through which the wheel 126 protrudes. When re-spooling (e.g., placing spoolable pipe 12 that has been deployed back on the reel 14) is desired, the re-spooler actuator 130 may be actuated to cause the wheel 126 to rotate in an opposite direction from the desired direction of the reel 14. In certain embodiments, the re-spooler actuator 130 may also be used to bring the wheel 126 in contact with the first and second reel ends 50 and 52. Alternatively, the wheel 126 may be left in contact with the first and second reel ends 50 and 52 when not re-spooling, thereby allowing the wheel 126 to free spin (e.g., the re-spooler actuator 130 is not actuated). The re-spooler actuator 130 may also be used to adjust the speed of re-spooling (e.g., rotational speed of the reel 14).

The wheel 126 of the pipe re-spooler 26 may be made from various materials, such as, but not limited to, rubber, plastic, or metal. The material for the wheel 126 may be selected to provide sufficient friction or grip to be able to cause the reel 14 to rotate when the wheel 126 is rotated. In addition, the wheel 126 may have a flexible or compliant surface to accommodate variations in roundness of the first and second reel ends 50 and 52 and to provide additional contact surface area when the wheel 126 is pushed against the first and second reel ends 50 and 52. In one embodiment, the wheel 126 may be a pneumatic vehicle tire. In addition, the wheel 126 may be detachably coupled to the re-spooler bracket 128 to be easily replaced when worn. The re-spooler actuator 130 may be an electric or hydraulic actuator or motor to enable movement of the wheel 126 toward or away from the first and second reel ends 50 and 52. The re-spooler bracket 128 may take different forms, but serves to support the wheel 126 and the re-spooler actuator 130. For example, the re-spooler bracket 128 may be coupled to the frame 16. In certain embodiments, the pipe re-spoolers 26 may be adjustable axially 42 to accommodate reels 14 of different reel widths 56. In further embodiments, the rollers 18 may include the functionality of the pipe re-spooler 26. In other words, the rollers 18 may be powered or actuated such that rotation of the rollers 18 in a first direction causes rotation of the reel 14 in a second direction opposite from the first direction. In such embodiments, the surface of the rollers 18 may be made from a material similar to the wheel 126 to provide sufficient friction between the rollers 18 and the first and second reel ends 50 and 52.

Figure 5:
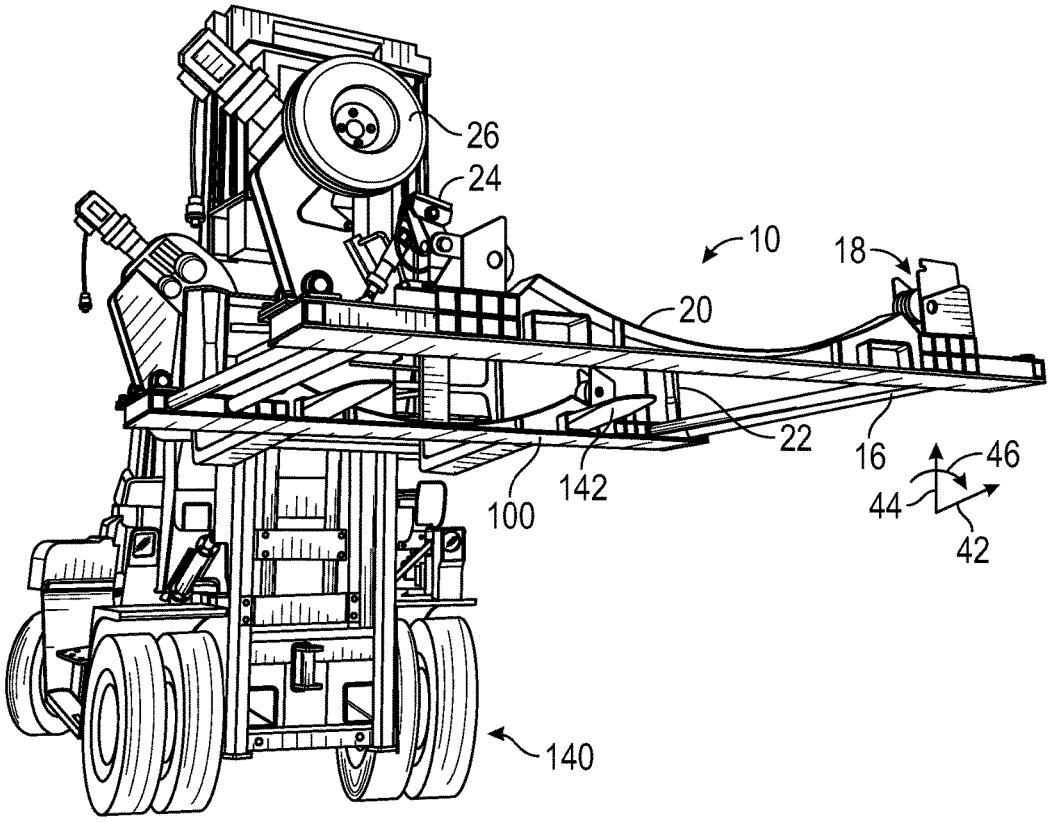
FIG. 5 is a perspective view of a pipe reel cradle being handled by a forklift according to embodiments of the present disclosure.

FIG. 5 illustrates a perspective view of an embodiment of the pipe reel cradle 10 being handled by a forklift 140. As shown in FIG. 5, tines 142 of the forklift 140 are inserted into the forklift tine pockets 100. Thus, the pipe reel cradle 10 may be lifted from one surface by the forklift 140, moved away, and set down on another surface by the forklift 140. In certain embodiments, the tines 142 of the forklift 140 may be moved apart from one another to lock the pipe reel cradle 10 in place or another fastening or securing technique may be used to secure the pipe reel cradle 10 to the forklift 140.

Figure 6:
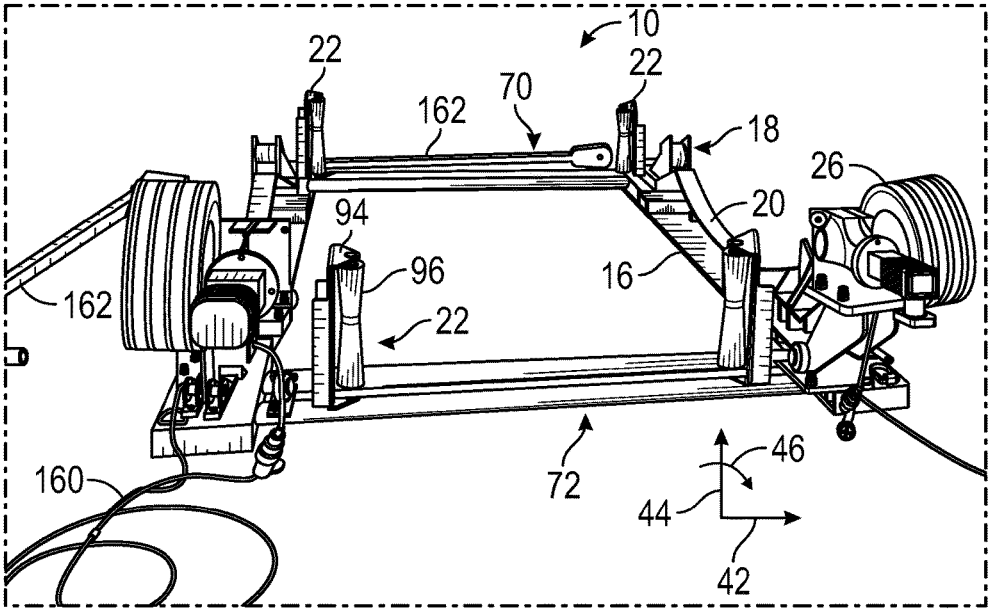
FIG. 6 is a perspective view of a rear side of a pipe reel cradle according to embodiments of the present disclosure.

FIG. 6 illustrates a perspective view of the rear side 72 of an embodiment of the pipe reel cradle 10. In the illustrated embodiment, the rollers 96 of the pipe guides 22 may be shaped as two conical frustums joined together at their narrow ends. Thus, the shape of the rollers 96 helps to maintain the deploying spoolable pipe 12 toward the middle of the rollers 96. In certain embodiments, one or more electrical cords 160 may be electrically connected to the electrical components of the pipe reel cradle, such as the brake actuator 124 or the re-spooler actuator 130. When components of the pipe reel cradle 10 are hydraulically-powered, one or more hydraulic hoses may be coupled to the pipe reel cradle 10. In some embodiments, certain functions of the pipe reel cradle 10 may be accomplished remotely via a wired or wireless remote control. In addition, FIG. 6 illustrates two pipe tension arms 162 that may be used with the pipe reel cradle 10, as described in detail below.

Figure 7:
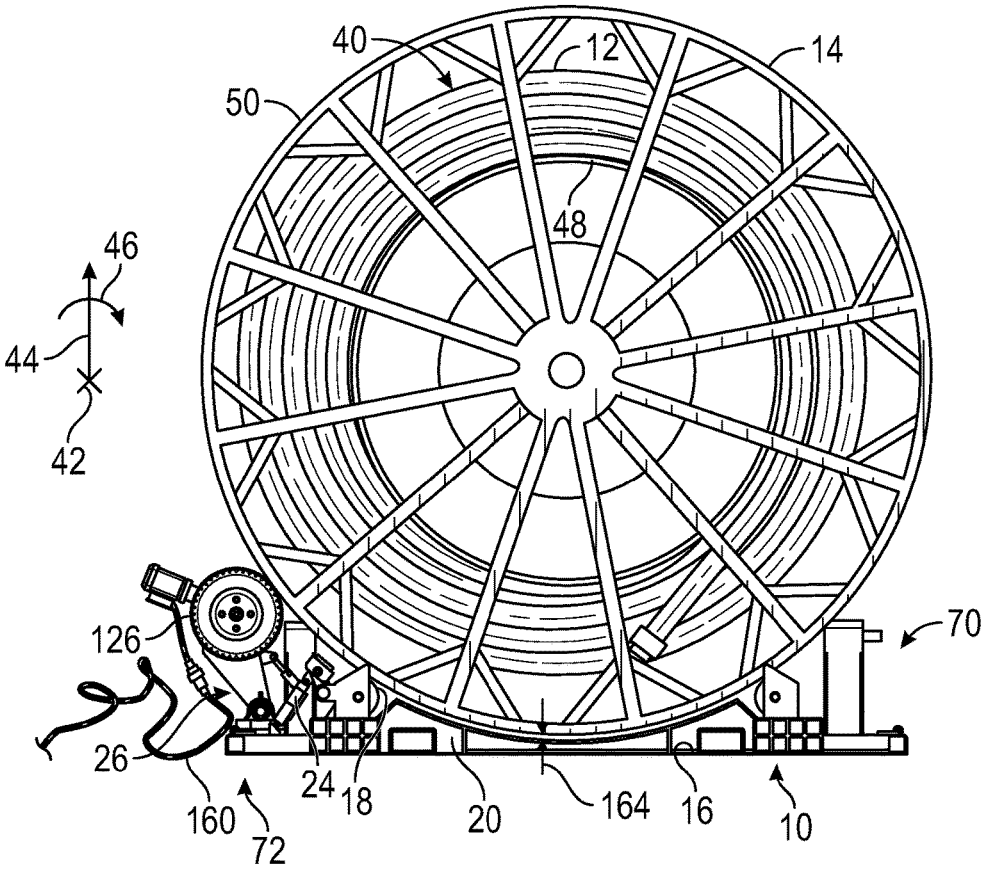
FIG. 7 is a perspective view of a pipe reel cradle with a reel according to embodiments of the present disclosure.

FIG. 7 illustrates a side perspective view of an embodiment of the pipe reel cradle 10 with the reel 14. As shown in FIG. 7, the first and second reel ends 50 and 52 rest on the rollers 18 (only first reel end 50 is visible). Thus, the rollers 18 enable the reel 14 to rotate as the spoolable pipe 12 is deployed from the reel 14. In contrast to other deployment methods, there is no rod that extends into the bore 54 to support the weight of the reel 14 and spoolable pipe 12. Instead, the rollers 18 of the pipe reel cradle 10 support the weight of the reel 14 and spoolable pipe 12. In addition, the wheel 126 of the pipe re-spooler 26 is shown in contact with the first and second reel ends 50 and 52. Further, a gap 164 is shown between the first and second reel ends 50 and 52 and the cradles 20. As discussed above, the reel 14 may not normally be in contact with the cradle 20 during deployment of the spoolable pipe 12. Instead, the cradles 20 may help support the reel 14 if the rollers 18 are intentionally or non-intentionally lowered radially 44 (e.g., if the rollers 18 are damaged or worn).

Figure 8:
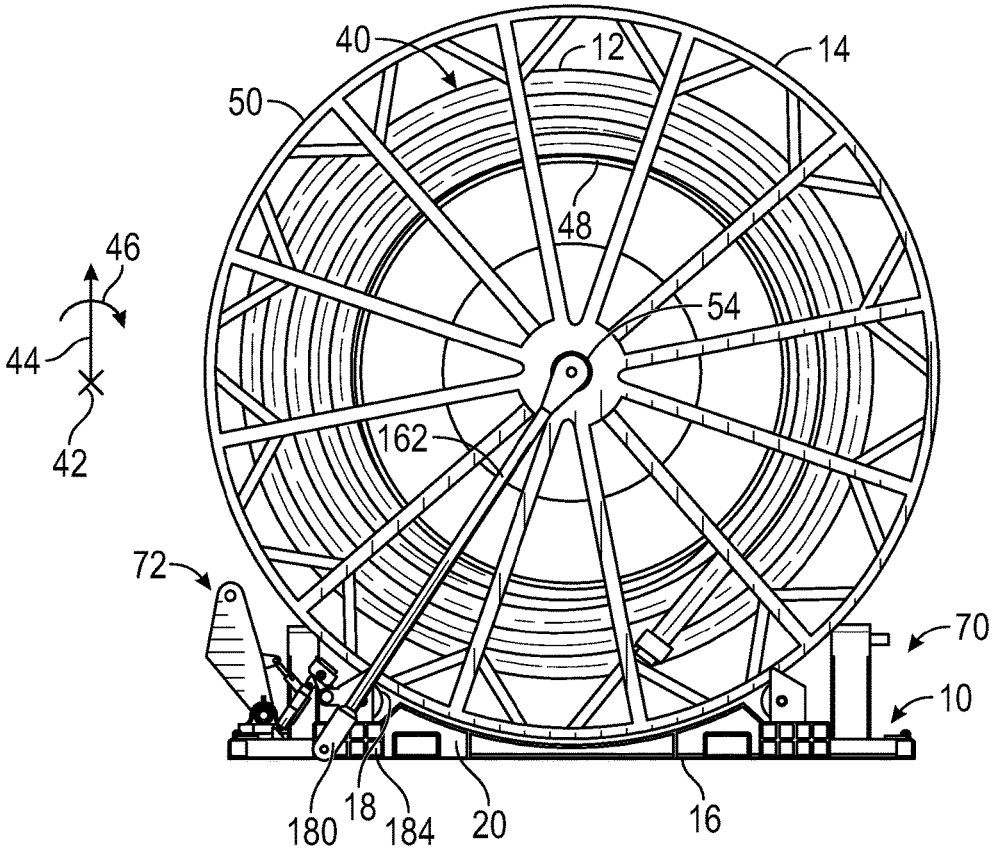
FIG. 8 is a side perspective view of a pipe reel cradle with a pipe tension arm according to embodiments of the present disclosure.

FIG. 8 illustrates a side perspective view of an embodiment of the pipe reel cradle 10 with the pipe tension arm 162. Although only one pipe tension arm 162 is shown in FIG. 8, a second pipe tension arm 162 may be used on the opposite side of the pipe reel cradle 10 in certain embodiments. As shown in FIG. 8, the pipe tension arm 162 has a first end 180 that removably couples to the frame 16 and a second end 182 that removably couples to the bore 54 of the reel 14. The pipe tension arm 162 may help maintain contact of the reel 14 against the rollers 18 or the pipe re-spooler 26 (not shown in FIG. 8). For example, the combined weight of the reel 14 and spoolable pipe 12 decreases as the spoolable pipe 12 is deployed, which may cause the reel 14 to lose contact with one or more of the rollers 18 or the pipe re-spooler 26. Thus, the pipe tension arm 162 may counteract any movement of the reel 14 away from the rollers 18 or the pipe re-spooler 26 by providing a fixed distance between the bore 54 and the frame 16. In certain embodiments, the frame 16 may include a plurality of arm holes 184 located at different locations for the first end 180 to be inserted into. Thus, the plurality of arm holes 184 enables pipe tension arms 162 with a fixed length to be used with reels 14 of different reel diameters 58.

Figure 9:
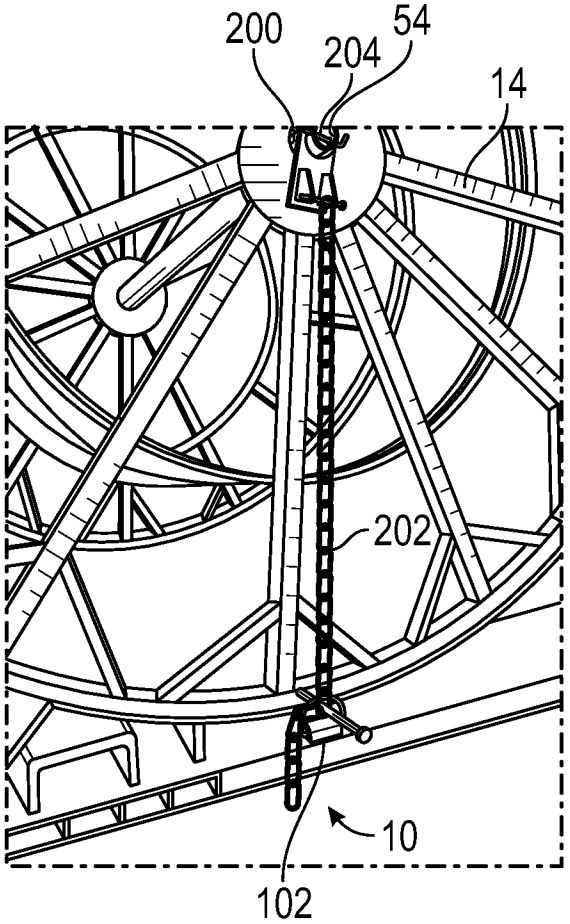
FIG. 9 is a side perspective view of a pipe reel cradle with a retention shaft according to embodiments of the present disclosure.
Figure 9:
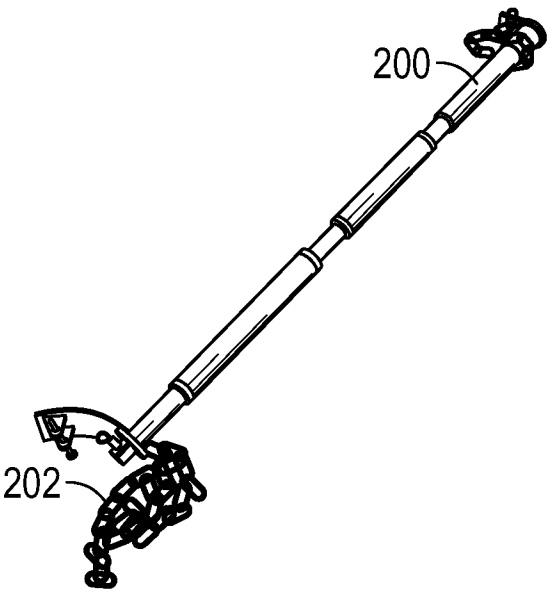

FIG. 9 illustrates a perspective view of an embodiment of the pipe reel cradle 10 with a retention shaft 200. As shown in FIG. 9, the retention shaft 200 may be used to secure the reel 14 to the pipe reel cradle 10 instead of or in addition to the pipe tension arm 162. The retention shaft 200 may be a cylindrical rod or shaft that is inserted into the bores 54 of the reel 14. In certain embodiments, the retention shaft 200 may include bearings or similar devices to enable the reel 14 to easily rotate about the retention shaft 200. A chain 202 may be coupled to one end of the retention shaft 200 and to the pipe reel cradle 10, such as to a pad eye 102 of the pipe reel cradle 10 or similar attachment point. Together the retention shaft 200 and chain 202 may help prevent the reel 14 from coming out of the pipe reel cradle 10 for any reason. In other words, the retention shaft 200 and chain 202 help keep the reel 14 within the pipe reel cradle 10. A cotter pin 204 or similar device may be used to secure the chain 202 to the retention shaft 200. In certain embodiments, a come-a-long or similar device may be used to tighten the chain 202. In further embodiments, other devices may be used for the chain 202, such as wire or rope. Although only one side of the reel 14 is shown in FIG. 9, the retention shaft 200 may be secured in a similar manner as described on both sides of the reel 14. In some embodiments, more than one chain 202 may be used on a side of the reel 14, such as two, three, or more chains 202. In these embodiments, the chains 202 may be secured to the same location of the pipe reel cradle 10 or to different locations. For example, if two chains 202 are used, they may be arranged like an inverted letter V with the tip representing the bore 54 and the legs representing the two chains 202. In certain embodiments, if the pipe tension arm 162, retention shaft 200, and/or chain 202 were to fail, the extensions 87, including flared versions of the extensions 87, may help retain the reel 14 within the pipe reel cradle 10.

Figure 10:
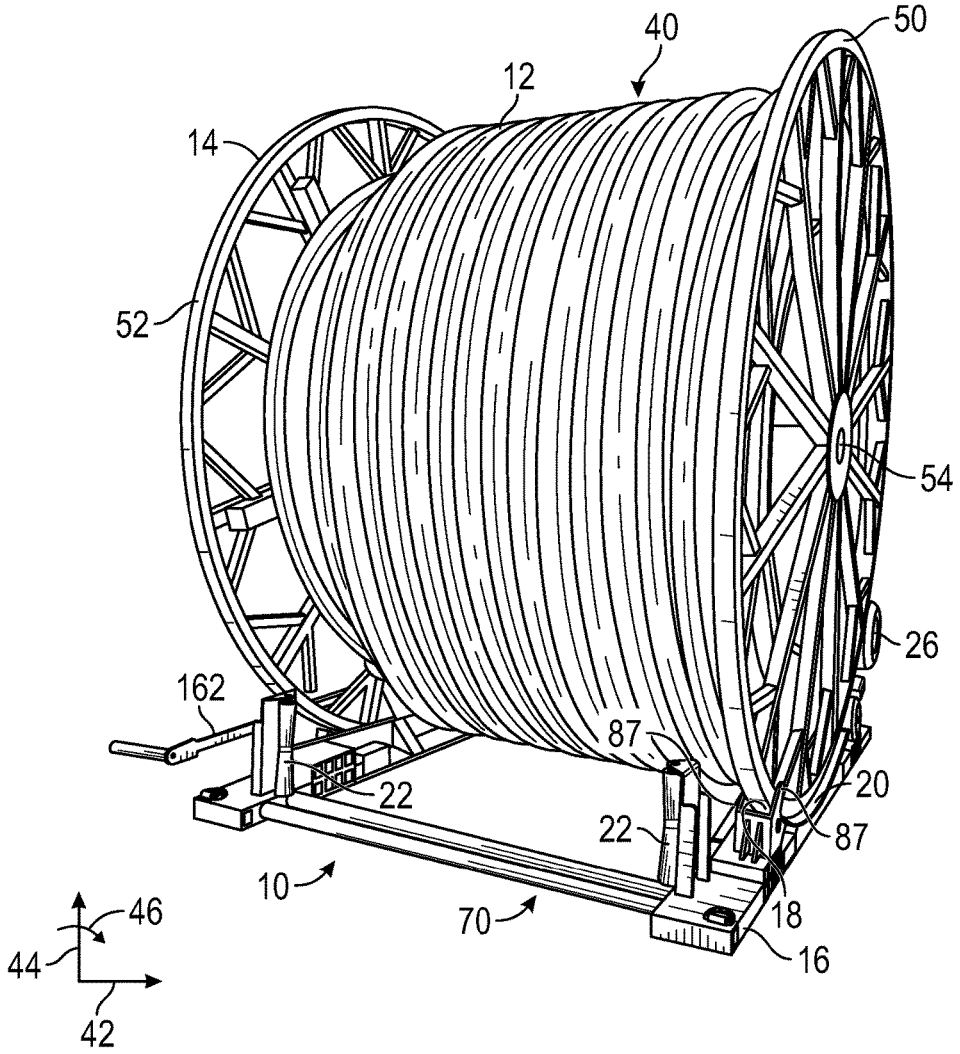
FIG. 10 is a perspective view of a front side of a pipe reel cradle with a reel according to embodiments of the present disclosure.

FIG. 10 illustrates a perspective view of the front side 70 of an embodiment of the pipe reel cradle 10 with the reel 14. As shown in FIG. 10, the extensions 87 of the roller frames 86 may extend radially 44 away from the rollers 18 to help prevent axial 42 movement of the first and second reel ends 50 and 52 outside of the rollers 18. Thus, undesired movement or tilting of the reel 14 may be avoided. In other embodiments, the pipe reel cradle 10 may include a containment system to at least partially support the reel 14 if the reel 14 is not supported by the rollers 18. For example, the containment system may include posts, beams, walls, or similar objects extending radially 44 away from the frame 16. Thus, if the reel 14 moves away from one or more of the rollers 18, the containment system may block further movement of the reel 14 outside the boundaries of the pipe reel cradle 10. Such a containment system may be useful when the pipe reel cradle 10 is not placed on a level surface or when the pipe reel cradle 10 is located on a moving surface, such as the deck of a ship.

When deploying spoolable pipe 12 using the pipe reel cradle 10, the pipe reel cradle 10 may be moved to a desired location using the forklift tine pockets 100 and/or pad eyes 102. Then the reel 14 may be set in the pipe reel cradle 10 using a crane or similar equipment. An end of the spoolable pipe 12 may be pulled away from the stationary reel 14 and pipe reel cradle 10, thereby causing the reel 14 to rotate against the rollers 18 as the spoolable pipe 12 is removed from the reel 14. Alternatively, the pipe reel cradle 10 may be placed on a trailer or similar equipment. The end of the spoolable pipe 12 may be removed from the reel 14 and secured. Then the pipe reel cradle 10 may be moved away from the stationary end causing additional spoolable pipe 12 to be deployed as the reel 14 rotates against the rollers 18. In either deployment method, the spoolable pipe 12 may be guided through the pipe guide 22 as the spoolable pipe 12 is deployed. When a desired amount of spoolable pipe 12 has been deployed or it is desired to pause or stop deployment for any reason, the pipe brake 24 may be engaged to slow or stop rotation of the reel 14. Deployment may be resumed after disengaging the pipe brake 24.

In some situations, it may be desired to re-spool deployed spoolable pipe 12. For example, the reel 14 may be in the pipe reel cradle 10 with a first portion of spoolable pipe 12 disposed about the reel 14 and a second portion of spoolable pipe 12 extending away from the reel 14. The pipe re-spooler 26 may then be engaged with the reel 14 and the pipe re-spooler 26 rotated to cause rotation of the reel 14 against the rollers 18 in a direction to cause the second portion to be re-spooled onto the reel 14. The spoolable pipe 12 may be guided through the pipe guide 22 during re-spooling. After re-spooling, the pipe re-spooler 26 may be disengaged from the reel 14 and the reel 14 may be removed from the pipe reel cradle 10 to be transported to another location.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system, comprising:

a frame;

a first pair of rollers coupled to a first side of the frame, wherein the first pair of rollers is configured to support a first end of a pipe reel;

a first cradle disposed longitudinally between the first pair of rollers;

a second pair of rollers coupled to a second side of the frame, wherein the second pair of rollers is configured to support a second end of the pipe reel;

a second cradle disposed longitudinally between the second pair of rollers;

a pipe guide coupled to a third side of the frame between the first and second sides;

a pipe brake coupled to the frame; and a pipe re-spooler coupled to the frame; wherein the pipe re-spooler comprises a wheel with a flexible surface configured to rotationally engage at least one of the first and second ends of the pipe reel; wherein the pipe brake comprises at least one of a brake pad or a caliper brake configured to engage a peripheral circumferential surface of the at least one of the first and second ends of the pipe reel.

2. The system of claim 1, wherein the pipe guide comprises a first bracket with a first roller and a second bracket with a second roller, and spoolable pipe disposed on the pipe reel is configured to pass between the first and second brackets.

3. The system of claim 1, comprising a pipe tension arm with a first end configured to couple to the frame and a second end configured to couple to a bore of the pipe reel, wherein the pipe tension arm is configured to maintain the pipe reel against at least one of the first and second pairs of rollers or the pipe re-spooler.

4. The system of claim 1, comprising:

a retention shaft configured to be inserted into a bore of the pipe reel; and a chain with a first end coupled to the retention shaft and a second end coupled to the frame, wherein the retention shaft and chain are configured to maintain the pipe reel against at least one of the first and second pairs of rollers or the pipe re-spooler.

5. The system of claim 1, wherein the frame comprises a rectangular frame with a first structural member at the first side, a second structural member at the second side, a third structural member at the third side, a fourth structural member at a fourth side, and the third and fourth structural members couple the first and second structural member together.

6. The system of claim 1, wherein the first and second cradles are configured to support the pipe reel when the pipe reel is not supported by the first and second pairs of rollers.

7. The system of claim 1, comprising a containment system configured to at least partially support the pipe reel when the pipe reel is not supported by at least one of the first and second pairs of rollers.

8. The system of claim 1, wherein the first and second pairs of rollers are configured as at least one of the pipe brake or the pipe re-spooler.

9. The system of claim 1, wherein the frame comprises at least one of forklift tine pockets or pad eyes for handling of the system.

10. A method, comprising:

providing a pipe reel cradle, comprising:

a frame;

a first pair of rollers coupled to a first side of the frame, wherein the first pair of rollers is configured to support a first end of a pipe reel;

a first cradle disposed longitudinally between the first pair of rollers;

a second pair of rollers coupled to a second side of the frame, wherein the second pair of rollers is configured to support a second end of the pipe reel;

a second cradle disposed longitudinally between the second pair of rollers;

a pipe guide coupled to a third side of the frame between the first and second sides; and a pipe brake coupled to the frame;

setting the pipe reel in the pipe reel cradle, wherein a spoolable pipe is disposed about the pipe reel;

guiding the spoolable pipe through the pipe guide as spoolable pipe is removed from the pipe reel;

rotating the pipe reel against the first and second pairs of rollers as spoolable pipe is removed from the pipe reel; and at least one of slowing or stopping rotation of the pipe reel by engaging the pipe brake against the pipe reel; wherein a pipe re-spooler comprises a wheel with a flexible surface configured to rotationally engage at least one of the first and second ends of the pipe reel; wherein the pipe brake comprises at least one of a brake pad or a caliper brake configured to engage a peripheral circumferential surface of the at least one of the first and second ends of the pipe reel.

11. The method of claim 10, wherein the spoolable pipe is removed from the pipe reel by at least one of pulling the spoolable pipe from the pipe reel cradle when the pipe reel cradle is stationary or moving the pipe reel cradle away from a stationary end of spoolable pipe.

12. The method of claim 10, comprising at least partially supporting the pipe reel via a containment system when the pipe reel is not supported by at least one of the first and second pairs of rollers.

13. The method of claim 10, providing the pipe reel cradle on a trailer, a lowboy, or a ship.

14. The method of claim 10, comprising re-rounding the spoolable pipe via a pipe re-rounder coupled to the frame.

15. A method, comprising:

providing a pipe reel cradle, comprising:

a frame;

a first pair of rollers coupled to a first side of the frame, wherein the first pair of rollers is configured to support a first end of a pipe reel;

a first cradle disposed longitudinally between the first pair of rollers;

a second pair of rollers coupled to a second side of the frame, wherein the second pair of rollers is configured to support a second end of the pipe reel;

a second cradle disposed longitudinally between the second pair of rollers;

a pipe guide coupled to a third side of the frame between the first and second sides; and a pipe re-spooler coupled to the frame;

setting the pipe reel in the pipe reel cradle, wherein a first portion of spoolable pipe is disposed about the pipe reel and a second portion of spoolable pipe extends away from the pipe reel;

engaging the pipe re-spooler against the pipe reel;

rotating the pipe re-spooler to cause rotation of the pipe reel against the first and second pairs of rollers to re-spool the second portion onto the pipe reel; and guiding the second portion through the pipe guide as the section portion is re-spooled; wherein the pipe re-spooler comprises a wheel with a flexible surface configured to rotationally engage at least one of the first and second ends of the pipe reel; wherein a pipe brake comprises at least one of a brake pad or a caliper brake configured to engage a peripheral circumferential surface of the at least one of the first and second ends of the pipe reel.

16. The method of claim 15, comprising:

disengaging the pipe re-spooler from the pipe reel; and removing the pipe reel with the re-spooled spoolable pipe from the pipe reel cradle.

17. The method of claim 15, comprising restraining the pipe reel against the pipe re-spooler via a pipe tension arm with a first end removably coupled to the frame and a second end removably coupled to a bore of the pipe reel.

18. The method of claim 15, comprising at least partially supporting the pipe reel via a containment system when the pipe reel is not supported by at least one of the first and second pairs of rollers.

* * * * *